US005123343A

United States Patent [19]

Willer

[11] Patent Number: 5,123,343

[45] Date of Patent: Jun. 23, 1992

[54] MULTICOLOR PRINTING OF PAPER WEBS

[75] Inventor: Robert A. Willer, Neenah, Wis.

[73] Assignee: James River Paper Company, Inc., Richmond, Va.

[21] Appl. No.: 776,906

[22] Filed: Oct. 16, 1991

Related U.S. Application Data

[63] Continuation of Ser. No. 620,261, Nov. 30, 1990, abandoned, which is a continuation of Ser. No. 479,222, Feb. 12, 1990, abandoned, which is a continuation of Ser. No. 241,795, Sep. 6, 1988, abandoned, which is a continuation of Ser. No. 918,835, Oct. 14, 1986, abandoned, which is a continuation of Ser. No. 785,449, Oct. 8, 1985, abandoned.

[51] Int. Cl.[5] ..... B41F 5/16; B41F 13/48

[52] U.S. Cl. ..... 101/23; 101/32; 101/176

[58] Field of Search ..... 101/175, 176, 177, 178, 101/137, 138, 142, 217, 6, 23, 32, 25, 22, 181, 183, 5, 6

[56] References Cited

U.S. PATENT DOCUMENTS

| | | | |
|---|---|---|---|
| 690,822 | 1/1902 | Avril | 101/23 |
| 805,699 | 11/1905 | Avril | 101/23 |
| 859,587 | 7/1907 | Sherwood | 101/217 |
| 1,428,795 | 9/1922 | Mezger | 101/217 |
| 1,528,660 | 3/1925 | Desperati | 101/217 |
| 1,653,199 | 12/1927 | Belcher | 101/177 X |
| 1,935,799 | 11/1933 | Jamison | 101/92 |
| 2,164,852 | 7/1939 | Zimmerman | 101/91 |
| 2,168,229 | 8/1939 | MacArthur | 101/181 |
| 2,220,903 | 11/1940 | Higgins et al. | 101/92 |
| 2,297,846 | 10/1942 | Benschoten | 101/177 X |
| 2,499,870 | 3/1950 | Luehrs | 101/177 |
| 2,673,517 | 3/1954 | Uhl | 101/212 X |
| 3,261,289 | 7/1966 | Cash et al. | 101/217 |
| 3,840,421 | 10/1974 | Peterson | 101/181 |

*Primary Examiner*—J. Reed Fisher
*Attorney, Agent, or Firm*—Cooper & Dunham

[57] ABSTRACT

A method and apparatus for multicolor printing of paper webs. The method provides a means for printing creped paper webs while maintaining precise control of color register in spite of any stretching of the web during the printing process. Apparatus is disclosed which comprises a plurality of rotary printing plates, each inked with an ink of an independent color, and a single blanket cylinder for transferring the colored inks in proper register from the plates to the blanket and from the blanket to the web. The blanket cylinder or the impression cylinder or both may be segmented which permits printing selected portions of the web without ironing out embossments in other areas of the web by the printing rolls.

18 Claims, 2 Drawing Sheets

MULTICOLOR PRINTING OF PAPER WEBS

This is a continuation of application Ser. No. 07/620,261, filed Nov. 30, 1990, (abandoned), which in turn is a continuation of Ser. No. 07/479,222 filed Feb. 12, 1990 (aban.), which in turn is a continuation of Ser. No. 07/241,795 filed Sept. 6, 1988 (aban.), which in turn is a continuation of Ser. No. 06/918,835 filed Oct. 14, 1986 (aban.), which in turn is a continuation of Ser. No. 06/785,449 filed Oct. 8, 1985 (aban.).

This invention relates to a method of and apparatus for dry offset printing of paper webs, e.g. creped tissue for paper napkins. In one of its more specific aspects, this invention relates to a method and apparatus for multicolor printing of paper webs suitable for various consumer products, such as table napkins, cocktail napkins, and the like which are at least partially embossed, e.g. coin edge embossments for cocktail napkins. The webs are usually creped during production to impart certain desirable properties, notably improved softness and absorbency, to the finished products, e.g. facial tissue, toilet tissue, paper towels, wipes, and napkins. Embossments may extend over the entire surface or over part of the surface of the web.

In many instances, it is desirable to imprint the tissue products with a design or indicia in more than one color. When creped paper is printed in more than one color on a rotary letterpress type printing press, register variations often make the finished product unacceptable due to misalignment of colors relative to one another. In current letterpress printers, the major source of register variation is uneven movement of the paper web moving between decks. Uneven movement of the web between the color plate cylinders may be caused by uneven tension in rolls, uncontrolled paper stretch, runout in pullrolls, imperfect roller speed coordination, and backlash and slippage in speed control units. Most register control methods attempt to improve control of the movement of the web or to improve holding of the paper web on the impression drum.

In an offset printing machine, a blanket cylinder between the plate cylinder and the impression cylinder transfers the ink from an inked plate to the object being printed. Dry offset printing is used commercially for printing, inter alia, paperboard cartons, and formed plastic and metal containers, for example, beverage cans and food containers. In some applications, one offset roller is used for each plate roller. When applied to multicolor printing of creped paper, such offset printing systems suffer the same disadvantages as those described hereinabove with respect to the letterpress printing system.

The method and apparatus of this invention now provides a means for overcoming the disadvantages of printing creped paper or fabric by rotary plate printing methods of the prior art. In particular, the method and apparatus of this invention permits multicolor printing of continuous sheet materials which are not dimensionally stable with precise control of register of the colors relative to one another in the printed pattern. In preferred specific embodiments of the present invention, embossed creped paper may be printed without ironing out the embossments, for example the edge embossment of paper napkins.

The novel features of the method and apparatus of this invention will be evident from the following detailed description and accompanying drawings wherein FIGS. 1 and 2 represent diagrammatically printing apparatus forming a part of this invention suitable for carrying out the method of the invention.

BRIEF DESCRIPTION OF THE DRAWINGS

With reference to FIG. 1, an arrangement of printing rolls is illustrated which is capable of producing a multicolor pattern or indicia on a creped paper web with precise registry of colors and without ironing of embossed sections of the web except in the general area being printed. The offset printing unit comprises an impression cylinder 20 and a blanket cylinder 22 having a segmented blanket wherein the reference numerals 24 represent blanket segments interspersed with cutout or unblanketed segments 26. A creped web 28 to be printed, having embossed segments 30 is fed between the rollers 20 and 22 in the direction indicated by the arrows. The spacing of the blanket segments 24 on blanket cylinder 22 is such that the blanket contacts that area of the web between the embossments 30, the cutout segments 26 permitting the embossed areas 30 to pass between cylinders 20 and 22 without ironing out the embossments.

Figure 1:
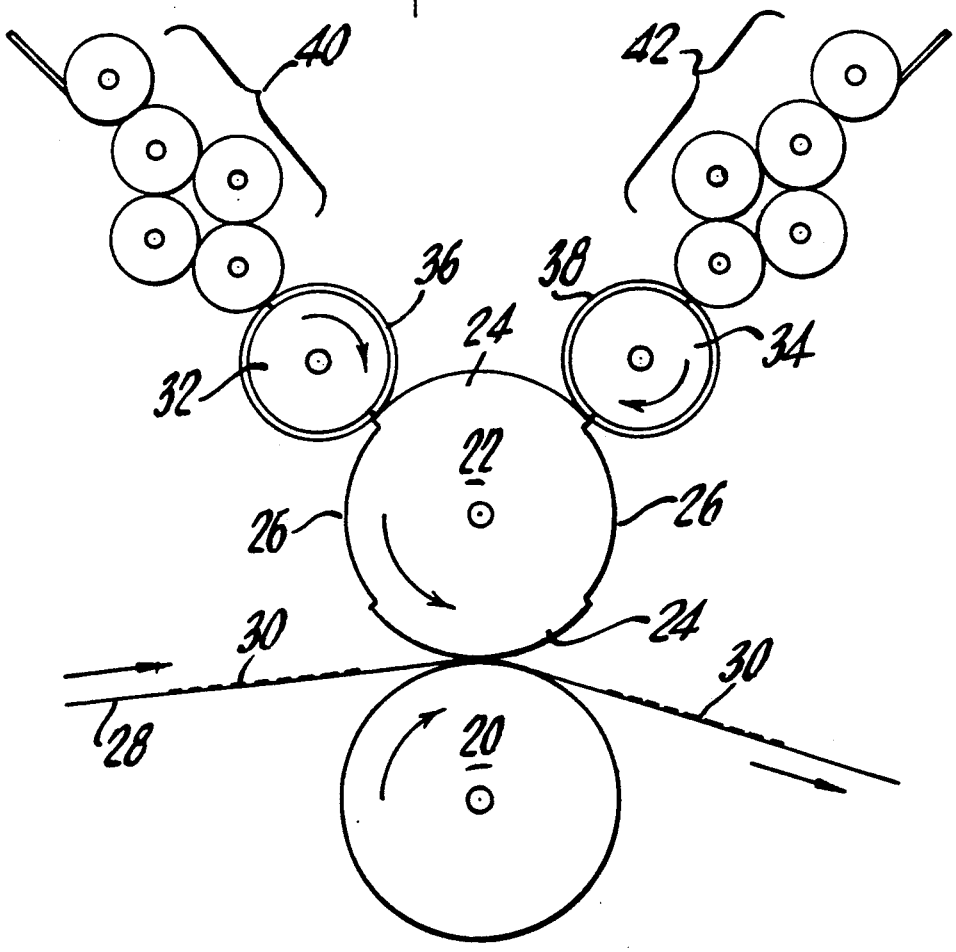
FIG. 1 is a side elevation view of a printing apparatus showing an impression cylinder and a blanket cylinder having a segmented blanket.

Plate rollers 32 and 34 carry printing plates 36 and 38, inked by ink rolls 40 and 42 respectively. Each of the plate rollers 34 and 32 sequentially transfers an image or impression in a single color onto the blanket segments 24 of blanket cylinder 22, which in turn transfers the multicolor composite pattern onto web 28. The cylinders 20 and 22, and plate cylinders 32 and 34 are driven at a precisely coordinated peripheral speed so that there is no slippage between cylinders. The transfer roll 22 ensures that the proper register of pattern and color will be imprinted on the creped web 28 regardless of irregularities in the movement of the web over the impression cylinder 20 due to stretching of the web. Suitable means, not illustrated, of conventional design and construction insure movement of the web over the impression cylinder at a predetermined rate ensuring proper alignment of the web for printing only the desired areas.

The embossments, designated in the figure by the numerals 30, are for the purpose of illustration shown as occurring at intervals along the length of the web 28. It is to be understood that the web may be entirely embossed and also that embossments (not illustrated) may occur along the edges of the web as well as at intervals along its length and that the blanket segments 24 need be only as wide as the area to be printed. Thus napkins having a printed center section and embossed edges, also known as coin embossments, as common in cocktail napkins and the like, may be printed without ironing out the edge embossments, and webs embossed over the entire surface will be partly ironed out only in the area contacted by the segments 24.

Figure 2:
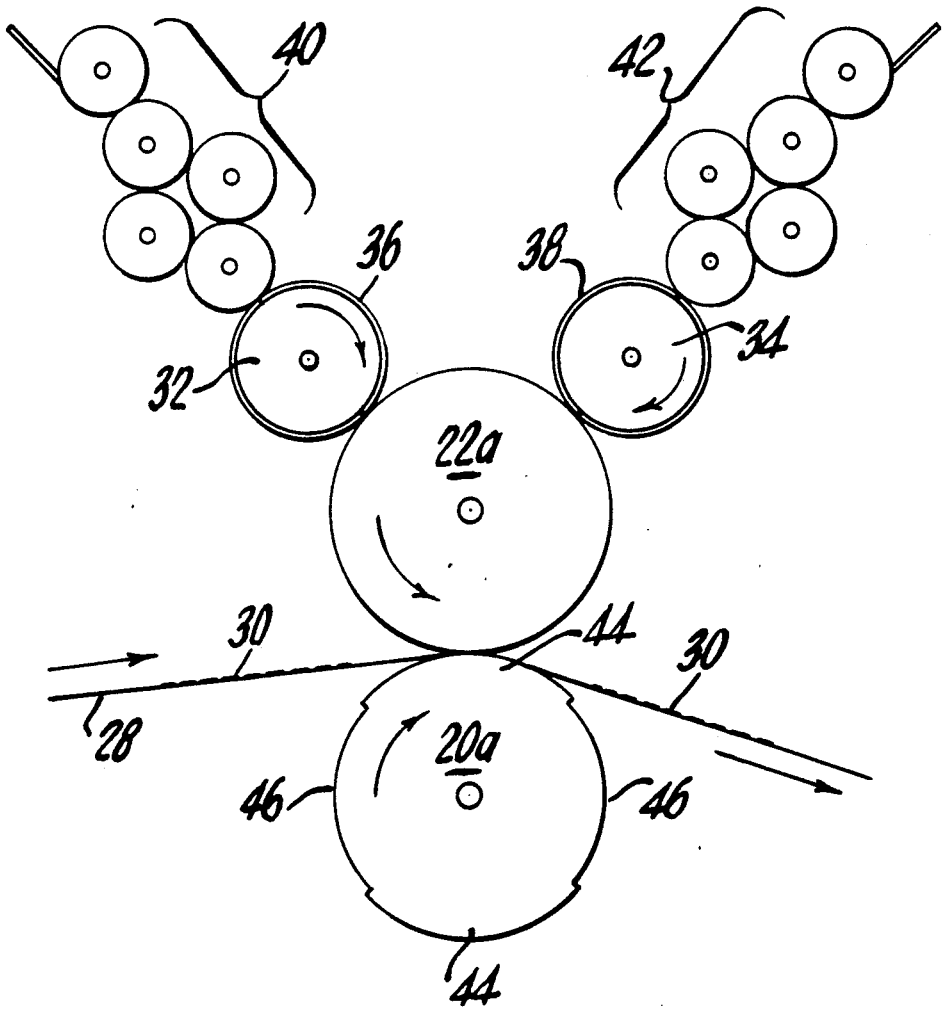
FIG. 2 is alternate embodiment showing a blanket cylinder having a continuous blanket surface and an impression cylinder having impression segments.

With reference to FIG. 2, an alternate preferred embodiment of apparatus is illustrated suitable for carrying out the method of this invention. As illustrated in FIG. 2, the blanket cylinder 22A has a continuous blanket surface for transferring inks from plate rolls 32 and 34 to the blanket and from the blanket to web 28. Impression cylinder 20A is provided with impression segments 44 cooperating with blanket roll 22A to transfer ink impressions to web 28 at suitable intervals along the length of the web between the embossments 30. Cutout segments 46 in the impression cylinder permit embossed areas 30 to pass between cylinders 20A and 22A without ironing out the embossments.

A number of advantages over conventional letterpress printing result from the method and apparatus of this invention for printing creped and embossed paper webs and products. In the process of this invention, a plurality of plate rollers transfer an inked impression on one blanket cylinder and as a result the separate colors are transferred to the paper in nearly perfect register. Thus the problems usually encountered in printing creped and embossed webs, sheets, or products due to stretch and movement of the paper between impressions is eliminated. At the same time, dust from the paper is less likely to accumulate on and cause plugging of printing plates. This advantage permits fine line, closely spaced printing of papers which do not have a hard finished surface and which are thus subject to dusting during the printing operation.

I claim:

1. In a web fed rotary offset printing press for continuous dry offset multicolor printing of previously embossed creped paper webs, the combination comprising:

a) a plurality of plate cylinders having printing plates mounted thereon;

b) means for applying a film of colored ink on each of the printing plates such that each plate is inked with a different color from that of the other plates;

c) an impression cylinder;

d) a single blanket cylinder which comprises a plurality of blanket segments which are circumferentially separated from one another, each segment making sequential rolling contact with the plates on each of the plate cylinders to form a composite multicolor pattern at each on the blanket segments, said blanket cylinder and said impression cylinder forming a nip therebetween which is a pressure nip when said blanket segments of the blanket cylinder are at the nip but is not a pressure nip when other portions of the blanket cylinder are at the nip; and e) means for feeding a previously embossed creped fibrous web to said nip between the blanket cylinder and the impression cylinder, wherein said previously embossed web has been embossed with a selected embossing pattern prior to making any contact with either of said impression cylinder and blanket cylinder, said embossing pattern comprising embossed portions spaced apart along the length of the web by non-embossed portions, for the printing of a multicolor pattern on said non-embossed portions of said web at said nip, wherein the impression and blanket cylinders are mounted and shaped to compress between them said non-embossed portions of the web at said blanket segments but to allow said embossed portions of the web to pass between the cylinders without ironing out embossing thereon.

2. Apparatus according to claim 1 wherein said impression cylinder comprises a plurality of raised segments separated from one another by an amount sufficient to permit said embossed portions of a web being printed to pass between the impression cylinder and the blanket cylinder without the cylinders ironing out embossing thereon.

3. Apparatus as in claim 1 in which said impression cylinder comprises a plurality of raised segments which engage said blanket segments of the blanket cylinder and are circumferentially separated from one another by depressed portions.

4. Apparatus as in claim 1 in which said impression cylinder is smooth throughout its circumference and is free of raised and sunken portions.

5. An apparatus according to claim 1, wherein said embossed creped paper web comprises an edge embossed crepe paper web and the width of each said blanket segment is no greater than the width of said embossed areas on said edge embossed creped paper web.

6. An apparatus according to claim 1, wherein said impression cylinder, said blanket cylinder and each of said plate cylinders are driven in sync at a coordinated peripheral speed so that there is no slippage between said cylinders.

7. In a web fed rotary printing press for continuous dry offset multicolor printing of creped paper webs, means for printing a coin edge embossed creped paper web with precise registry of colors without ironing out other, embossed portions of the web comprising:

a) a plurality of plate cylinders having printing plates mounted thereon;

b) means for applying a film of colored ink on each of the printing plates such that each plate is inked with a different color from that of the other plates;

c) an impression cylinder;

d) a single blanket cylinder which comprises a plurality of blanket segments which are circumferentially spaced from one another such that each blanket segment makes sequential rolling contact with the plates on each of the plate cylinders and contacts only unembossed areas on the web to print thereon, wherein the impression and blanket cylinders are mounted and shaped to form a nip therebetween which permits embossed portions of the web to be fed to and to pass through said nip between the blanket cylinder and the impression cylinder without ironing out of the embossing at portions of the web which are at the nip formed between the impression cylinder and portions of the circumference of said blanket cylinder which are between said blanket segments;

wherein said web has embossed portions spaced from each other along the length of the web by non-embossed portions before making any contact with either of said impression cylinder and said blanket cylinder; and e) means for continuous feeding of said creped fibrous web through said nip between the blanket cylinder and the impression cylinder for the printing of a multicolor pattern on some portions thereof while permitting other portions to pass through said nip without ironing out the embossing thereon.

8. Apparatus as in claim 7 in which the blanket cylinder comprises raised portions which form said blanket segments and are circumferentially spaced from each other by depressed portions.

9. Apparatus as in claim 8 in which said impression cylinder is smooth throughout its circumference and is free of raised and sunken portions.

10. Apparatus as in claim 7 in which said impression cylinder comprises raised portions which engage said blanket segments of the blanket cylinder and are circumferentially spaced from each other by depressed portions.

11. An apparatus according to claim 7, wherein the width of each said blanket segment is no greater than the width of said unembossed areas on said coin edge embossed creped paper web.

12. An apparatus according to claim 7, wherein said impression cylinder, said blanket cylinder and each of said plate cylinders are driven in sync at a coordinated peripheral speed so that there is no slippage between said cylinders.

13. A method for multicolor web fed printing of a coin edge embossed creped paper web in a web fed rotary printing press which comprises providing a plurality of plate cylinders having printing plates mounted thereon;

providing means for applying a film of colored ink on each of the printing plates such that each plate is inked with a different color from that of the other plates;

providing an impression cylinder;

providing a single blanket cylinder which comprises a plurality of blanket segments which are circumferentially separated from one another, each segment making sequential rolling contact with the plates on each of the plate cylinders to form a composite multicolor pattern at each of the blanket segments, said blanket cylinder and said impression cylinder forming a nip therebetween which is a pressure nip when said blanket segments of the blanket cylinder are at the nip but is not a pressure nip when other portions of the blanket cylinder are at the nip;

the steps of feeding a previously embossed creped fibrous web to said nip between the blanket cylinder and the impression cylinder, wherein said previously embossed web has been embossed with a selected embossing pattern prior to making any contact with either of said impression cylinder and blanket cylinder, said embossing pattern comprising embossed portions spaced apart along the length of the web by non-embossed portions, for the printing of a multicolor pattern on said non-embossed portions of said web at said nip, wherein the impression and blanket cylinders are mounted and shaped to compress between them said non-embossed portions of the web at said blanket segments but to allow said embossed portion of the web to pass between the cylinder without ironing out embossing thereon, transferring an ink pattern from each of said plurality of printing plates inked in different colored inks sequentially onto discrete individual blanket segments of said single blanket cylinder to form said composite multicolor pattern thereon, and transferring the composite multicolor pattern from a blanket segment onto unembossed portions of the web while permitting embossed portions of the web to pass through the printing press without contact by a blanket segment and without ironing out said embossed portions, wherein said coin edge embossed paper has embossed portions before it makes any contact with said printing press.

14. A method according to claim 13, wherein at least one of said embossed portions comprises an edge embossment and the width of said blanket cylinder is no greater than the unembossed portion of said edge embossed web.

15. A method according to claim 13, wherein said impression cylinder and said blanket cylinder are driven in sync at a coordinated peripheral speed so that there is no slippage between said cylinders.

16. A paper tissue product made by the method of claim 13.

17. A paper tissue product made by the method of claim 14.

18. A paper tissue product made by the method of claim 15.

* * * * *